US006994566B2

(12) United States Patent
You

(10) Patent No.: US 6,994,566 B2
(45) Date of Patent: Feb. 7, 2006

(54) CIRCUIT BOARD MOUNTED ELECTRICAL CONNECTOR

(75) Inventor: Sun Zhao You, Shanghai (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/706,264

(22) Filed: Nov. 12, 2003

(65) Prior Publication Data

US 2004/0121629 A1 Jun. 24, 2004

(30) Foreign Application Priority Data

Nov. 15, 2002 (TW) ..... 91218512 U

(51) Int. Cl.
*H01R 13/41* (2006.01)

(52) U.S. Cl. ..... 439/66; 439/733.1; 439/862

(58) Field of Classification Search ..... 439/74, 439/66, 862, 630, 733.1
See application file for complete search history.

(56) References Cited

U.S. PATENT DOCUMENTS 4,969,844 A * 11/1990 Sako et al. ..... 439/733.1
5,879,169 A * 3/1999 Wu ..... 439/74
6,231,394 B1 * 5/2001 Schnell et al. ..... 439/630
6,276,941 B1 * 8/2001 Wu ..... 439/66
6,398,598 B2 * 6/2002 Masumoto ..... 439/862
6,447,338 B1 * 9/2002 Bricaud et al. ..... 439/630
6,659,784 B1 * 12/2003 Klein et al. ..... 439/733.1

* cited by examiner

*Primary Examiner*—Briggitte R. Hammond
(74) *Attorney, Agent, or Firm*—Charles S. Cohen

(57) ABSTRACT

An electronic card connector comprises an insulating housing, a plurality of conductive terminals, and a plurality of terminal passageways penetrating the insulating housing from its top to its bottom. The conductive terminals can be respectively received in corresponding terminal passageways. In addition to a base portion, each conductive terminal comprises a soldering tail and a contact portion, and they are disposed at the opposite ends of the conductive terminal respectively. Accepting recesses are formed at the bottom of the insulating housing to receive the soldering tail. Interference portions designed to hold the soldering tails are formed on the inner walls of the accepting recesses. An elevated platform is formed in the middle of each accepting recess for being pressed against by the soldering tail. An approximately U-shaped slot is formed in between two neighboring accepting recesses to enhance the holding strength of the interference portion to the soldering tail.

16 Claims, 3 Drawing Sheets

CIRCUIT BOARD MOUNTED ELECTRICAL CONNECTOR

BACKGROUND OF THE INVENTION (A) Field of the Invention

The present invention is related to an electronic card connector, more specifically, to an electronic card connector installed inside a communication equipment, such as a cellular phone, to be connected to a corresponding identification card, for example, a SIM card.

(B) Description of the Related Art

Examples of some memory card connectors are shown in Chinese Patent No. 99125707 and in Taiwanese Patent No. 86212738. Such memory card connectors typically include a dielectric housing having a plurality of terminal-receiving passages which extend between a top mating face of the housing and a bottom board-mounting face of the housing, along with a plurality of conductive metal terminals mounted in the passages. The terminals are pushed into the passages from the bottom face of the housing. Each conductive terminal includes a base located in the passage, a solder tail extending from the base and a contact portion which extends from an opposite end of the base and expose at the top mating face of the housing for engaging the contacts of a memory card. The solder tails are soldered to circuit traces on a circuit board to which the connector is mounted.

As shown in FIGS. 7 and 8, existing electronic card connectors are designed in such a way that a conductive terminal 71 is held in a terminal passageway 72 through an interference body 712 of a base portion 711, whereas the insulating housing 70 itself is not equipped with any interference portion to specifically hold the soldering tail 713. The insulating housing 70 will expand when being heated up, whenever the electronic card connector is soldered onto a circuit board. However, when being soldered onto the circuit board, the soldering tail 713 does not follow to alter its own shape. So, the holding force provided by the interference body 712 of the base 711 is insufficient to prevent the insulating housing 70 from deforming and bending upward. As a result, the soldering tail 713 is separated from the insulating housing 70, and thus affects the performance of the electronic card connector.

SUMMARY OF THE INVENTION

In order to solve the problems above, the present invention improves the existing electronic card connectors to put forth an electronic card connector having conductive terminals more firmly held.

The electronic card connector provided by the present invention comprises an insulating housing with a top and a bottom, a plurality of conductive terminals, and a plurality of terminal passageways penetrating from the top of the insulating housing to its bottom; the conductive terminals are received in the corresponding terminal passageways. Each conductive terminal is approximately U-shaped, and comprises a base portion, a soldering tail extending from one end of the base portion, a connecting portion bending and extending from the other end of the base portion, and a contact portion extending from the connecting portion. The base portion is provided with at least one interference body. A plurality of accepting recesses are formed at the bottom of the insulating housing to receive the soldering tail. An interference portion designed to hold the soldering tail is formed on at least one of the inner walls of the accepting recess. The interference portion is shaped approximately as a semi-cylinder.

An elevated platform is formed in the middle of the accepting recess. The elevated platform is lower than the interference portion, inducing the soldering tailor and the bottom of the insulating housing to be on the same plane whenever the conductive terminal is received in the corresponding terminal passageway. A U-shaped slot may be formed between two neighboring accepting recesses to enhance the interference effect of the interference portion.

In order to reinforce holding for the entire terminal, the base portion of the conductive terminal is provided with at least one wing, and at least one holding hole is formed on both sides of the terminal passageway on the bottom of the insulating housing to hold the corresponding wing.

In the meanwhile, to prevent the terminals from deformation, a resistance portion shaped as a traverse rod extends from the front of the contact portion, and a blockade portion is formed inside the part of a terminal passageway near the top of the insulating housing. The blockade portion precisely presses against the resistance portion of the conductive terminal whenever the contact portion is pushed into the corresponding terminal passageway, which occurs when the electronic card connector is connected with an identification card.

The benefits of the present invention are as follows. The soldering tail of the conductive terminal is effectively held. The bonding stability between the conductive terminal and the insulating housing is enhanced. The disconnection of the soldering tail from the insulating housing due to the heat-induced expansion of the latter is prevented to ensure the performance of the electronic card connector.

DETAILED DESCRIPTION OF THE INVENTION

Figure 1:
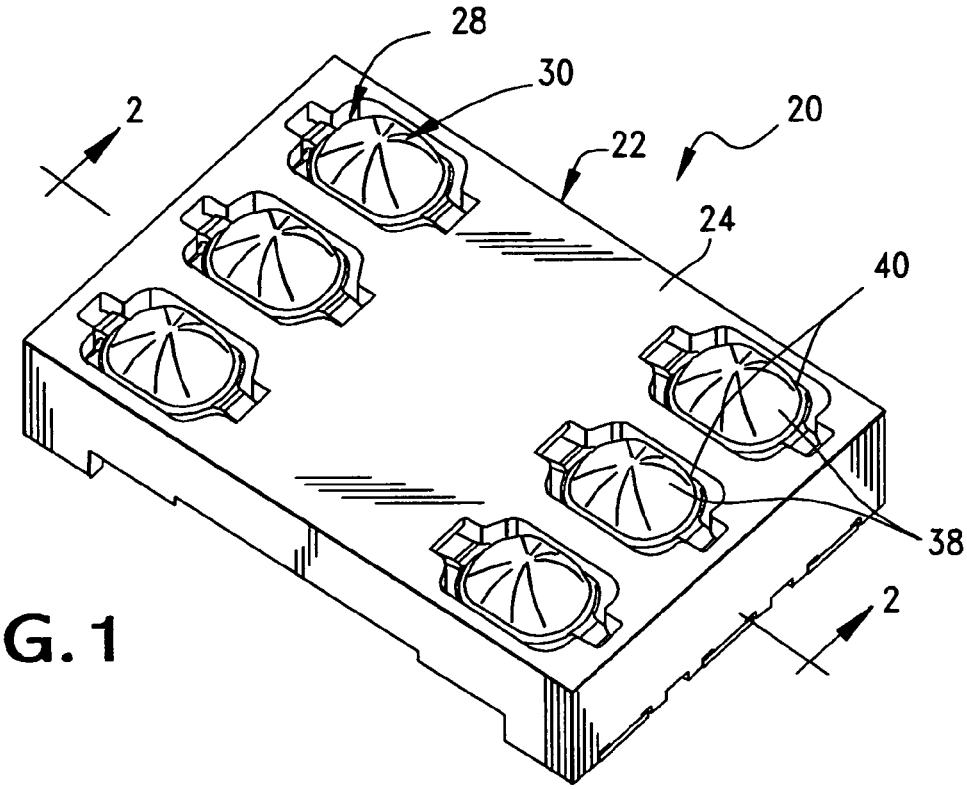
FIG. 1 is a three-dimensional view of a preferred embodiment according to the present invention.

The following description, associated with the attached drawings, is intended to illustrate a preferred embodiment of the present invention.

As shown in FIGS. 1 through 4, an electronic card connector 1 essentially comprises an insulating housing 10 having a top 100 and a bottom 101 oppositely disposed, a plurality of approximately U-shaped conductive terminals 11 and a plurality of terminal passageways 12 penetrating the insulating housing from the top 100 of the insulating housing 10 to its bottom 101. The conductive terminals 11 are being held in the corresponding terminal passageways 12 respectively.

Figure 2:
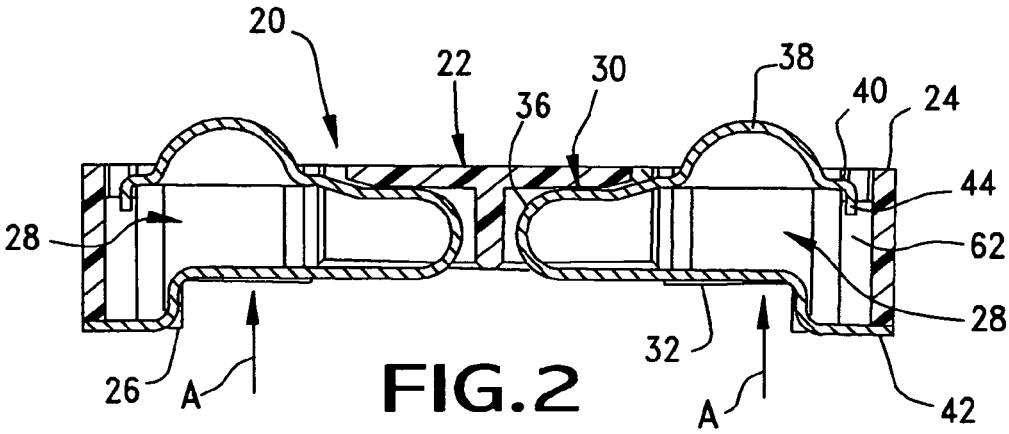
FIG. 2 is a cross-sectional view taken along line A—A of FIG. 1.
Figure 6:
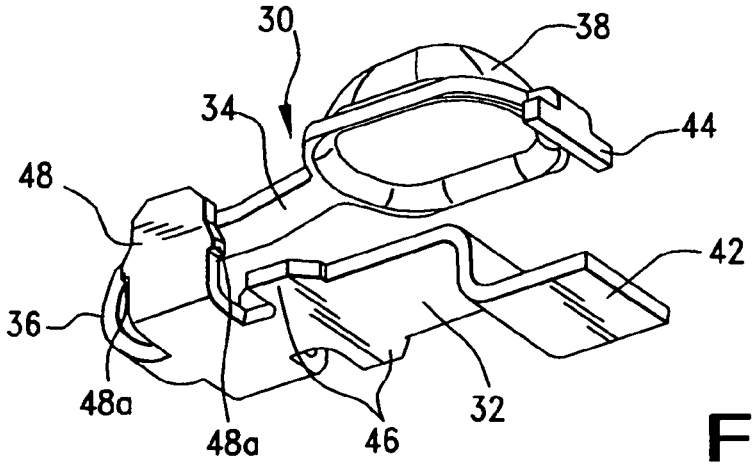
FIG. 6 is a three-dimensional view of the conductive terminal of the preferred embodiment depicted in FIG. 1.
Figure 3:
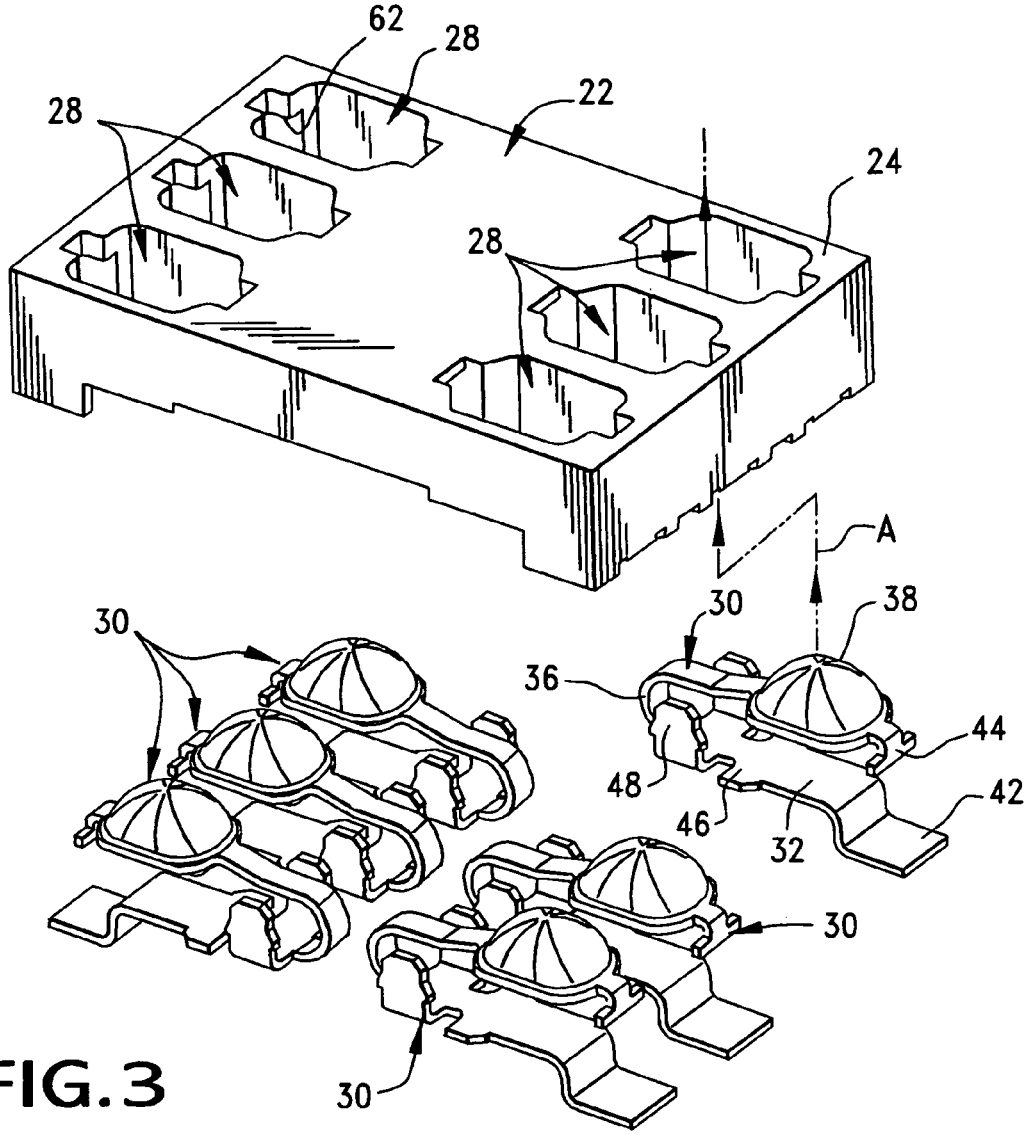
FIG. 3 is a three-dimensional view showing the disassembled parts of the structure of the preferred embodiment depicted in FIG. 1.
Figure 5:
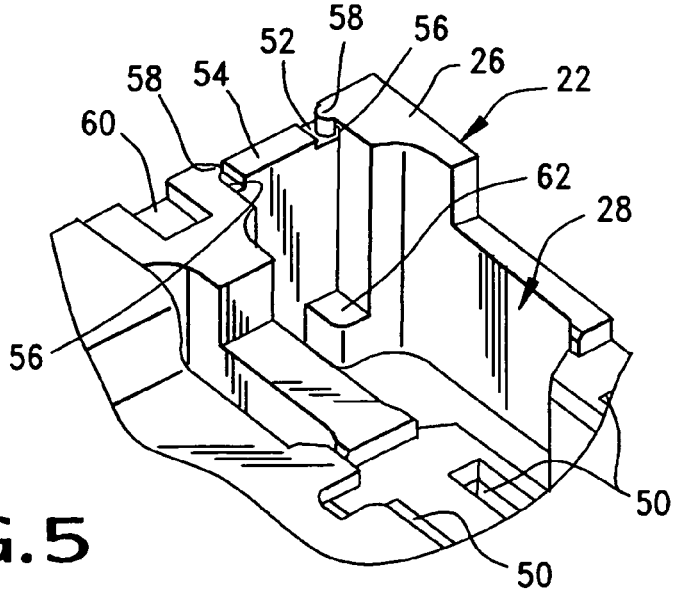
FIG. 5 is a magnified inset derived from FIG. 4.
Figure 4:
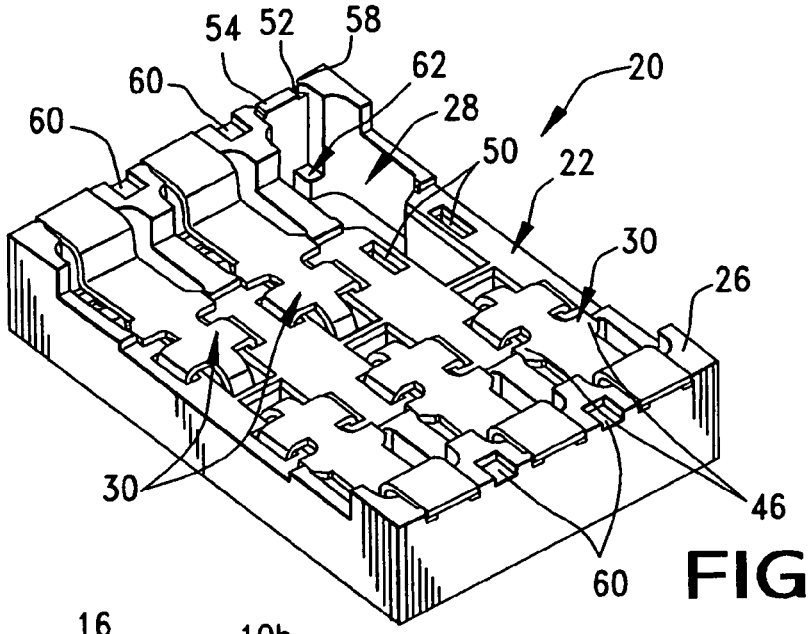
FIG. 4 is a three-dimensional view of the preferred embodiment depicted in FIG. 1 but observed from another angle after a conductive terminal has been removed therefrom.
Figure 7:
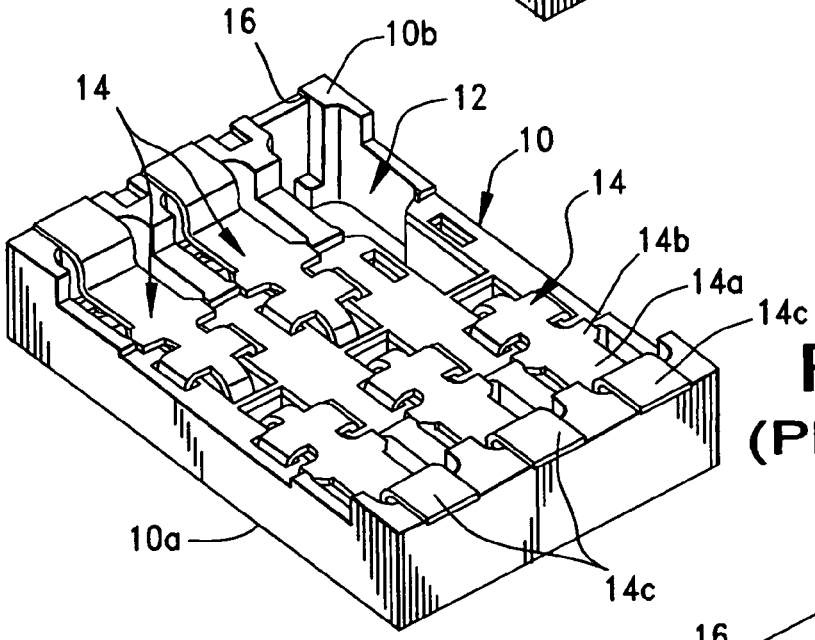
FIG.7 (PRIOR ART)
FIG. 7 is a three-dimensional schematic view of a prior art electronic card connector after a conductive terminal has been removed therefrom.
Figure 8:
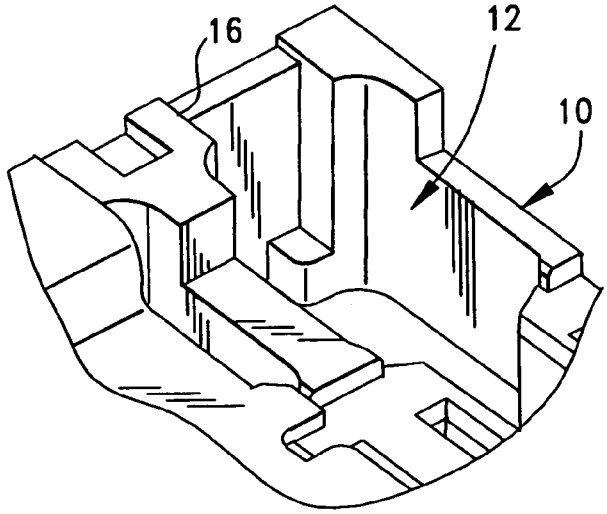
FIG.8 (PRIOR ART)
FIG. 8 is a magnified inset derived from FIG. 7.

As shown in FIGS. 2, 3 and 6, each conductive terminal 11 comprises a base portion 111 equipped with two interference bodies 116 and two wings 117 (the interference bodies 116 horizontally extending outward from the base portion 111 whereas the wings 117 extend from the base portion 111 vertically), a soldering tail 112 extending from one end of the base portion 111, a connecting portion 113 bending and extending from the other end of the base portion 111, a contact portion 114 extending from the connecting portion 113, and a resistance portion 115 shaped as a traverse rod extending from the front of the contact portion 114.

As shown in FIGS. 2 through 5, a blockade portion 20 is formed inside the part of the terminal passageway 12 near the top 100 of the insulating housing 10. The contact portion 114 of the conductive terminal 11 is pushed into the corresponding terminal passageway 12 whenever the electronic card connector 1 is connected to an identification card. As a result, the blockade member 20 precisely leans against the resistance portion 115 of the conductive terminal 11 so as to prevent the deformation of the conductive terminal 11.

An accepting recess 106 is formed at the bottom 101 of the insulating housing 10 to hold the soldering tail 112 of the conductive terminal 11. The bottom 101 beside each side of the terminal passageway 12 is equipped with a holding hole 104 to match the corresponding wings 117 of the conductive terminal 11. Accordingly, the wings 117 are held inside the corresponding holding holes 104 so that the conductive terminal 11 can be held more firmly. Both sides of the inner walls of each accepting recess 106 are each equipped with an interference portion 102 shaped as a semi-cylinder. The interference portions 102 horizontally stick out from the inner walls of the accepting recesses 106 so as to hold the soldering tail 112. An elevated platform 105 is formed in the middle of each accepting recess 106 for being pressed against by the soldering tail 112.

When installing the conductive terminal 11, the conductive terminal 11 is pushed into the corresponding terminal passageway 12 from the bottom 101 of the insulating housing 10, inducing the wings 117 to be held inside the corresponding holding holes 104, and the soldering tail 112 presses against the elevated platform 105 and is held inside the accepting recess 106 by the interference portion 102. The interference body 116 precisely presses against the sidewall of the terminal passageway 12. The elevated platform 105 is lower than the interference portion 102 so as to ensure that both the soldering tail 112 and the bottom 101 of the insulating housing 10 are on the same plane.

It is preferential that another U-shaped slot 103 is formed at the bottom of the insulating housing 10 between two accepting recesses 106, so as to increase the elasticity of the interference portion 102 with a view to hold the conductive terminal 11 more firmly.

The above-described embodiments of the present invention are intended to be illustrative only. Numerous alternative embodiments may be devised by those skilled in the art without departing from the scope of the following claims.

What is claimed is:

1. An electrical connector, comprising:

a dielectric housing having a top mating face, a bottom face for mounting on a circuit board and a plurality of terminal-receiving passages extending between the faces;

a plurality of conductive terminals mounted on the housing and each terminal including a base mounted in a respective one of the passages in the housing, a solder tail extending from one end of the base for connection to an appropriate circuit trace on the circuit board, and a contact portion extending from an opposite end of the base and exposed at the mating face of the housing for engaging an appropriate contact of a complementary connecting device; and said housing including a plurality of holding slots at the bottom face thereof, including at least one inner side wall having an inwardly projecting interference member, for receiving a side edge of a respective solder tail of the terminals with interference fits to rigidly fix the solder tails to the housing.

2. The electrical connector of claim 1 wherein each of said holding slots has an elevated platform on which a respective solder tail is positioned to maintain the solder tail generally flush with the bottom face of the housing.

3. The electrical connector of claim 1 wherein said dielectric housing is molded of plastic material, the holding slots have opposite inner side walls, and the housing has cut-out areas between adjacent slots to increase the elasticity of the side walls.

4. The electrical connector of claim 1 wherein each holding slot has an opposing pair of said inner side walls having inwardly projecting, opposing interference members for engaging opposite side edges of the respective solder tail.

5. The electrical connector of claim 4 wherein said interference members have rounded engaging surfaces for engaging the opposite side edges of the respective solder tail.

6. The electrical connector of claim 1 wherein the base of each of said terminals includes at least one interference portion for engaging a side wall of a respective passage with an interference fit.

7. The electrical connector of claim 6 wherein the base of each of said terminals includes a pair of said interference portions in the form of wings projecting from opposite edges of the base for engaging opposite side walls of the respective passage with an interference fit.

8. The electrical connector of claim 1 wherein said terminals are stamped and formed of sheet metal material, and each terminal is generally U-shaped to define a pair of legs joined by a bent portion of the terminal, one leg defining said base and the opposite leg defining a spring arm bent back over the base and having said contact portion thereon.

9. The electrical connector of claim 8 wherein the solder tail of each U-shaped terminal is formed at a distal end of said one leg which defines the base, and the contact portion of each U-shaped terminal is formed as a contact dome projecting from one side of said opposite leg which defines said spring arm.

10. The electrical connector of claim 9, including complementary interengaging stop means between the housing and a distal end of said spring arm to limit the degree of flexing of the arm.

11. An electrical connector, comprising:

a dielectric housing having a top mating face, a bottom face for mounting on a circuit board and a plurality of terminal-receiving passages extending between the faces;

a plurality of generally U-shaped terminals mounted on the housing and each terminal defining a pair of legs joined by a bent portion of the terminal, one of said legs of the U-shaped terminal defining a base mounted in a respective one of the passages in the housing with a solder tail extending from one end of the base for connection to an appropriate circuit trace on the circuit board, and an opposite leg of the U-shaped terminal defining a spring arm bent back over the base and a contact portion formed as a contact dome projecting from one side of the spring arm and exposed at the mating face of the housing for engaging an appropriate contact of a complementary connecting device; and said housing including a plurality of holding slots at the bottom face thereof for receiving the solder tails of the terminals with interference fits to rigidly fix the solder tails to the housing, each slot including a pair of opposite inner side walls having inwardly projecting opposing interference members having rounded engaging surfaces for engaging opposite side edges of the respective solder tail.

12. The electrical connector of claim 11 wherein each of said holding slots has an elevated platform on which a respective solder tail is positioned to maintain the solder tail generally flush with the bottom face of the housing.

13. The electrical connector of claim 11 wherein said dielectric housing is molded of plastic material and includes cut-out areas between adjacent slots to increase the elasticity of the side walls of the slots.

14. The electrical connector of claim 11, including complementary interengaging stop means between the housing and a distal end of said spring arm to limit the degree of flexing of the arm.

15. The electrical connector of claim 11 wherein the base of each of said terminals includes at least one interference portion for engaging a side wall of a respective passage with an interference fit.

16. The electrical connector of claim 15 wherein the base of each of said terminals includes a pair of said interference portions in the form of wings projecting from opposite edges of the base for engaging opposite side walls of the respective passage with an interference fit.

* * * * *